US005551136A

United States Patent [19]

Bartlett

[11] Patent Number: 5,551,136

[45] Date of Patent: Sep. 3, 1996

[54] PAD REMOVAL DEVICE

[75] Inventor: Steve Bartlett, Livermore, Calif.

[73] Assignee: Advanced Micro Devices, Inc., Sunnyvale, Calif.

[21] Appl. No.: 421,587

[22] Filed: Apr. 12, 1995

[51] Int. Cl.[6] ..... B66F 3/00

[52] U.S. Cl. ..... 29/239; 29/267; 254/131; 254/129

[58] Field of Search ..... 254/256, 243, 254/129, 130, 131, 17; 29/267, 239

[56] References Cited

U.S. PATENT DOCUMENTS

| | | | |
|---|---|---|---|
| 485,611 | 11/1892 | Copper et al. | 254/256 |
| 723,244 | 3/1903 | Cox et al. | 254/256 |
| 1,063,063 | 5/1913 | Rains . | |
| 1,459,693 | 6/1923 | Rand et al. . | |
| 2,423,903 | 7/1947 | Roach | 254/256 |
| 2,516,357 | 7/1950 | Winebrenner . | |
| 2,996,283 | 8/1961 | Johnson | 254/256 |
| 3,907,254 | 9/1975 | Richards . | |
| 4,055,330 | 10/1977 | Chapman | 254/131 |
| 4,066,242 | 1/1978 | Allevato | 254/256 |
| 4,250,769 | 2/1981 | Herring . | |
| 4,280,683 | 7/1981 | Knierim . | |
| 4,475,716 | 10/1984 | Jarmin et al. . | |
| 4,512,554 | 4/1985 | Racine | 254/131 |
| 4,527,358 | 7/1985 | Day . | |
| 4,558,542 | 12/1985 | Marton . | |
| 4,991,893 | 2/1991 | Gordon et al. . | |
| 5,186,437 | 2/1993 | Scott . | |
| 5,293,908 | 3/1994 | Lefever et al. . | |

*Primary Examiner*—Robert C. Watson
*Attorney, Agent, or Firm*—Harold T. Fujii

[57] ABSTRACT

A tool for removing a polishing pad adhesively attached to a rotatable platen including a base, a lever member, at least one canted or angled latch pin, a chain having a plurality of links or rings, means for clamping the pad, and stop pins. The base is substantially flat and is engageable with a top or contact surface of the pad. The stop pins are attached to the base and are engageable with the platen. The lever is pivotally attached to the base, and has at least one latch pin attached thereto. A latch pin is engageable with each of the links of the chain. One end of the chain is pivotally attached to the clamping means. In operation, a portion of the pad disposed proximate the distal portion of the platen, is pried away from the top surface of the platen, and the clamp means is attached thereto. The base is disposed onto the contact surface of the pad such that the stop pins are in brought into contact with the near edge of the platen. The lever is swung in a forward direction and a canted latch pin is engaged with a link of the chain. The lever is then pulled in a rearward direction thereby pulling the pad from the top surface of the platen. As the lever is pulled in a rearward direction, the stop pins engage the platen and prevent the base from moving in a forward direction on the pad. The lever is rotated to the maximum extent of its travel then the canted latch pin is disengaged from the link. The lever is then swung forward and into engagement with another link of the chain. The operation is repeated until the pad is removed from the platen.

12 Claims, 4 Drawing Sheets

PAD REMOVAL DEVICE

FIELD OF THE INVENTION

The present invention relates to pads used in planarizing or polishing machines, to polish or buff the surface of a semiconductor wafer. More specifically, the present invention relates to a device for removing or pulling the pad from a top surface of a rotatable platen disposed in a processing chamber of such planarizing or polishing machines.

BACKGROUND OF THE INVENTION

Semiconductor wafers are generally planarized or polished, in a planarizing or polishing machine, before thin films are applied using chemical vapor deposition (CVD), oxidation, or sputtering processes. In a typical planarizing or polishing machine, a polishing or buffing pad is adhesively attached to and covers the entire upper surface of a heavy rotatable platen. The platen is disposed atop a drive assembly which is disposed within a processing chamber of the machine. Semiconductor wafers to be processed, arc held in a support assembly which is vertically translated between a first position to a second position. In the first position, the wafer is disposed apart from and above the platen. In the second position, the wafer is in contact with the pad. During a planarizing or polishing operation, the drive assembly rotates the platen, thereby rotating the attached pad. The support assembly lowers the wafer from the first position, and into the second position, i.e., into rubbing contact with the rotating pad, thereby planarizing or polishing a surface of the wafer.

The pad is removed and replaced once or twice per twelve hour shift. In order to remove a pad, a technician reaches into the processing chamber of the machine to grasp and pull on a portion of the pad. In typical polishing or planarizing machines, the processing chamber is surrounded by walls forming a cabinet. An access opening is provided in one of the walls of the cabinet, and is formed approximately three feet above ground level. Since the platen and the pad are approximately two to three feet in diameter, a technician must reach approximately two to three feet into the processing chamber in order to grasp the distal portion of the pad. Also, because of the location of the access opening, the technician generally must bend over at the waist in order to pass his/her arms and upper body through the access opening and into the processing chamber. Once an adequate handhold on a portion of the pad is achieved and while remaining in the bent over position, the technician pulls on the pad, with a force of approximately 40–80 pounds, to peel it off the upper surface of the platen. The technician is exposed to substantial risk of lower back injury because she must exert a significant pulling force while bent over at the waist.

There is, therefore, a great need to provide a device or tool for assisting the technician in removing buffing and polishing pads from platens in semiconductor wafer planarizing or polishing machines.

SUMMARY OF THE INVENTION

It is therefore an object of the invention to provide a pad removal device for removing a buffing or polishing pad which is adhesively attached to a platen disposed within a processing chamber of a planarizing or polishing machine.

It is another object of the present invention to provide a pad removal device for removing a buffing or polishing pad, adhesively attached to a platen disposed within a processing chamber of a planarizing or polishing machine, that is operable from a standing position.

It is still another object of the present invention to provide a pad removal device for removing a buffing or polishing pad, adhesively attached to a platen disposed within a processing chamber of a planarizing or polishing machine, that applies a plurality of discrete force levels to the pad.

It is yet another object of the present invention to provide a pad removal device for removing a buffing or polishing pad, adhesively attached to a platen disposed within a processing chamber of a planarizing or polishing machine, that can be used with a platen of any diameter.

Briefly, a tool for removing a polishing pad adhesively attached to a rotatable platen includes a base, a lever member, at least one canted or angled latch pin, a chain having a plurality of links or rings, means for clamping the pad, and stop pins. The base is substantially flat and is engageable with a top or contact surface of the pad. The stop pins are attached to the base and are engageable with the platen. The lever is pivotally attached to the base, and has at least one latch pin attached thereto. A latch pin is engageable with each of the links of the chain. One end of the chain is pivotally attached to the clamping means. In operation, a portion of the pad disposed proximate the distal portion of the platen, is pried away from the top surface of the platen, and the clamp means is attached thereto. The base is disposed onto the contact surface of the pad such that the stop pins are in brought into contact with the near edge of the platen. The lever is swung in a forward direction and a canted latch pin is engaged with a link of the chain. The lever is then pulled in a rearward direction thereby pulling the pad from the top surface of the platen. As the lever is pulled in a rearward direction, the stop pins engage the platen and prevent the base from moving in a forward direction on the pad. The lever is rotated to the maximum extent of its travel then the canted latch pin is disengaged from the link. The lever is then swung forward and into engagement with another link of the chain. The operation is repeated until the pad is removed from the platen.

An important advantage of the present invention is that a technician does not have to exert a pulling force to the pad while he is bent over at the waist and reaching into the processing chamber of the planarizing or polishing machine.

Another advantage of the present invention is that the pad removal device is simple to operate.

Still another advantage of the present invention is that the pad removal device is adjustable in order to vary the amount of pulling force that is applied to the pad.

These and other objects and advantages of the present invention will no doubt become apparent to those skilled in the art after having read the following detailed description of the preferred embodiment which is contained in and illustrated by the various drawing figures.

BRIEF DESCRIPTION OF THE DRAWINGS

The present invention is illustrated in more detail in the accompanying figures in which.

DETAILED DESCRIPTION OF THE PREFERRED EMBODIMENT

The following detailed description illustrates the invention by way of example, not by way of limitation of the principles of the invention. This description will clearly enable one skilled in the art to make and use the invention, and described several embodiments, adaptations, variations, alternatives and uses of the invention, including what I presently believe is the best mode of carrying out the invention.

Figure 1:
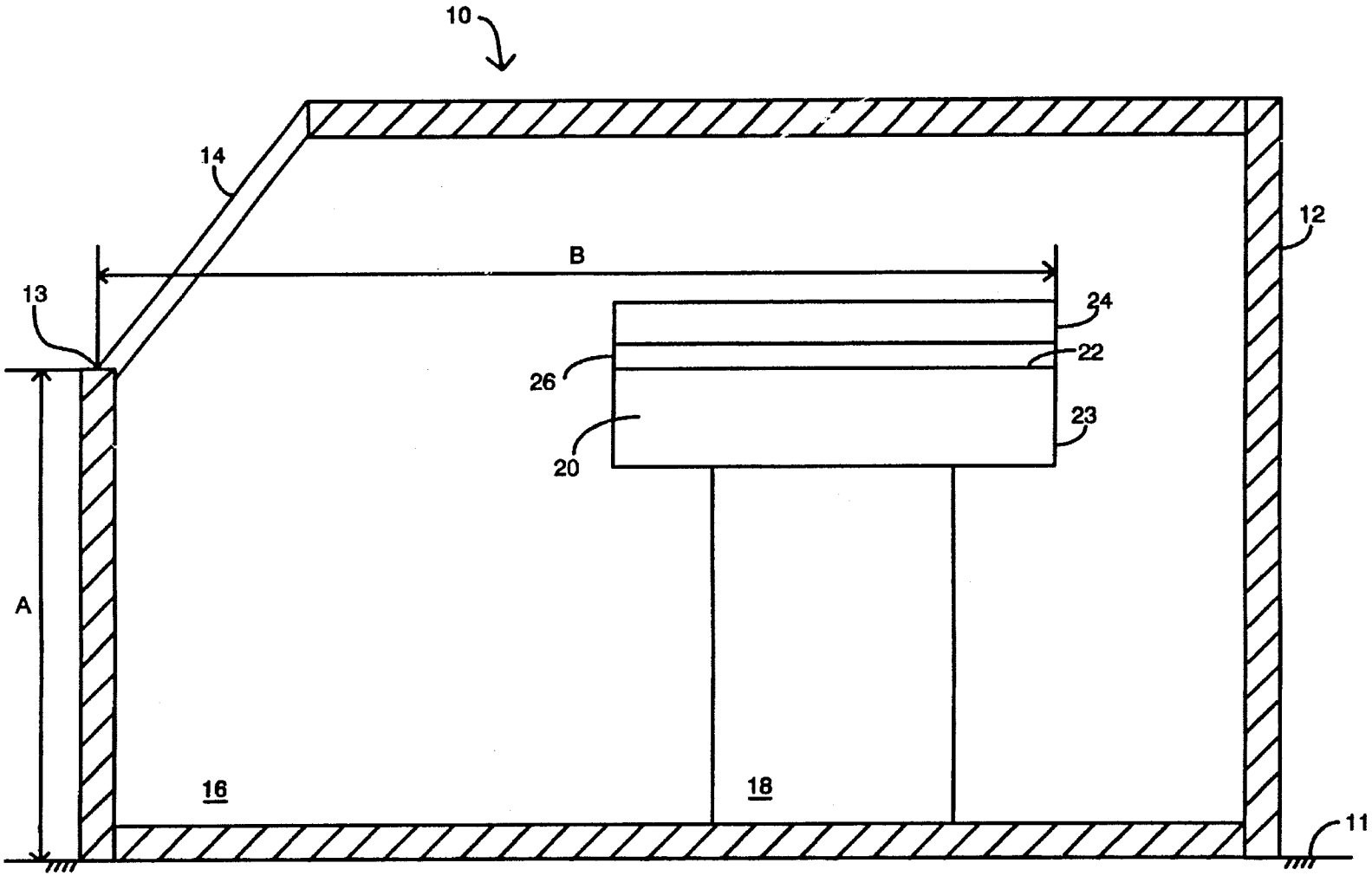
FIG. 1 is a partial sectional view schematically showing a polishing or planarizing machine including a cabinet forming a processing chamber, a rotatable platen disposed within the processing chamber, and a polishing or buffing pad attached to a top surface of the platen.

FIG. 1 is a partial sectional view schematically illustrating a planarizing or polishing machine 10. The machine 10 is disposed on the ground 11, and includes a cabinet 12 which encloses a processing chamber 16. A drive assembly 18 is disposed within the processing chamber 16. A rotatable platen 20, typically made of metal (e.g., aluminum) or granite, is mounted at one end of the assembly 18. A polishing or buffing pad 24 is attached, via an adhesive 26, to a top surface 22 of the platen 20. An access opening 14 is provided in the cabinet 12 in order to move wafers into and out from the chamber 16. The opening 14 also permits a technician to reach into the chamber 16 so as to perform maintenance tasks on the assembly 18, the platen 20, and the pad 24. The semiconductor wafers to be processed in the processing chamber are held in a support assembly which is attached to the cabinet and is disposed above the pad and platen. The wafers and the wafer support assembly are not shown in the figure for clarity.

A lower edge 13 of the access opening 14 is approximately disposed a distance A above the surface of the ground 11. A far edge 23 of the platen 20 is approximately disposed a distance B from the lower edge 13 of the access opening 14 of the cabinet 12. In typical planarizing or polishing machines, the distance A ranges from two to three feet, and the distance B ranges from three to four feet.

Figure 2:
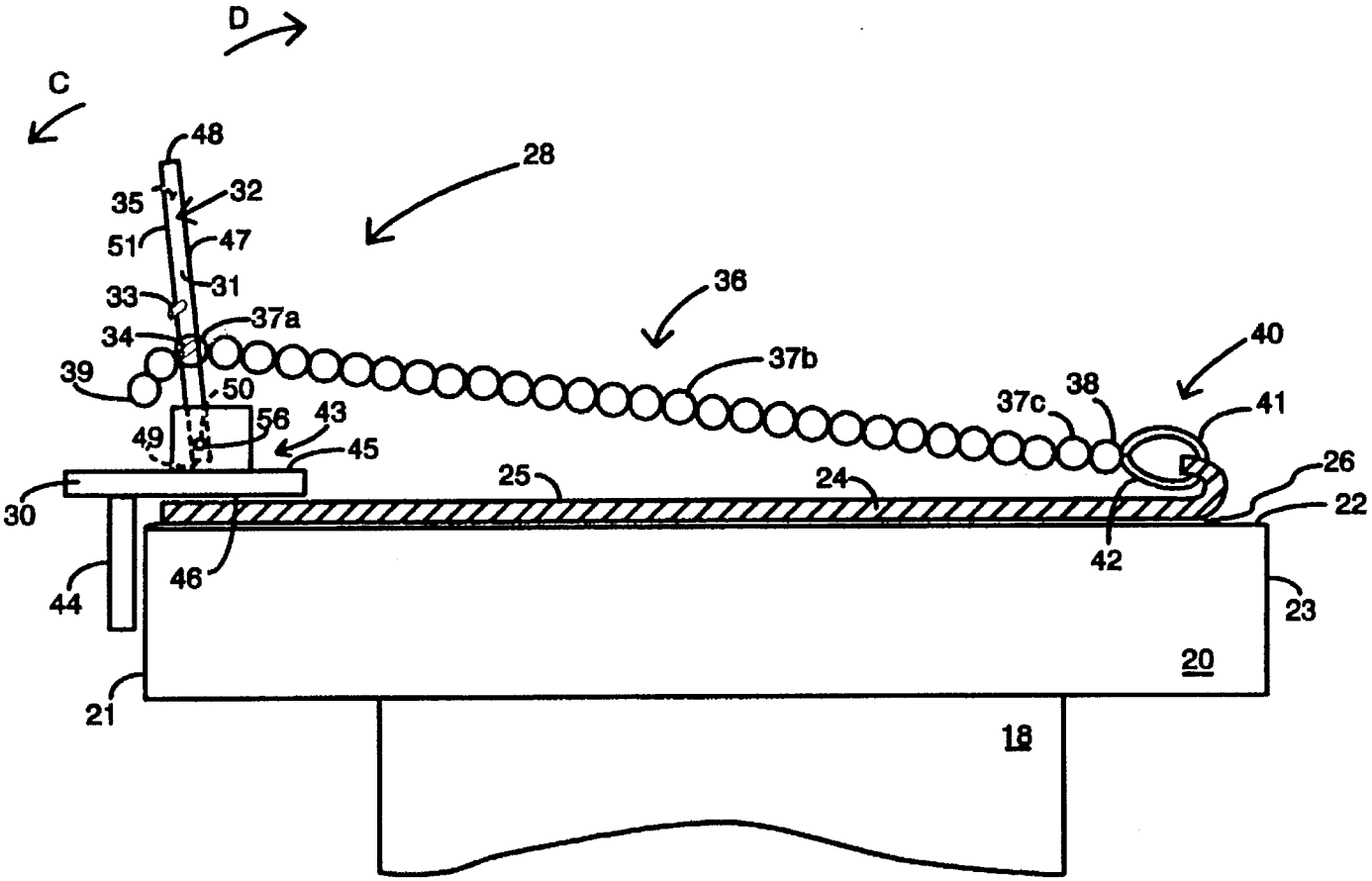
FIG. 2 is a side view illustrating one embodiment of the present invention.

FIG. 2 is a side view of one embodiment of a pad removal device 28 of the present invention. The device 28 includes an elongated lever 32 which is pivotally attached, via a swivel assembly 43, to a base 30. A plurality of latch pins 33, 34 are attached to a surface of the lever 32. The chain 36 includes a free end 39, and a swivel attachment means 38 attached to an other end of the chain 36. The chain 36 includes a plurality of links, or rings, or loops 37 (of which only three links **37*a*, 37*b*, and 37*c* are identified with reference numerals). A latch pin is engageable with each of the links. For example, as illustrated, the latch pin 34 is engaged within the link 37*a*. A clamping means 40 is attached to the swivel attachment means 38. The means 40 is used to clamp the pad 24 between a pair of gripping jaws 41,42 that are disposed in a confronting relationship. The means 38 permits the link 37*c* and the means 40** to rotate relative to one another about the axis (not shown) that is directed perpendicular to the plane of the paper on which FIG. 2 is illustrated.

The means 40 may include a device wherein the jaws 41 and 42 are spring-biased together, or a device wherein the jaws are moved together and apart by turning a screw or threaded bolt. The means 38 may include a hinge, or pin-in-sleeve style device.

The base 30 is substantially flat and includes a top surface 45 and a bottom surface 46. In the preferred embodiment, the base in generally rectangular. The swivel assembly 43 is mounted to the surface 45, while the surface 46 is engageable with a contact surface 25 of the pad 24. A means for bracing the base 30 against the platen 20, includes a plurality of stop pins 44 being attached to and downwardly extending from the surface 46. Although only one pin is shown in the figure, in the preferred embodiment, two pins are attached to the surface 46. The stop pins 44 are engageable with a near edge surface 21 of the platen 20.

The lever 32 includes an upper end 48 and a lower end 49. In the preferred embodiment, the lever 32 has a generally rectangular-shaped cross section. More specifically, the lever 32 has a front facing surface 47, a rear facing surface 51, and side surfaces 31 and 35. A hole or bore 50 is formed through the surfaces 31 and 35, and is located proximate the lower end 49.

Figure 3:
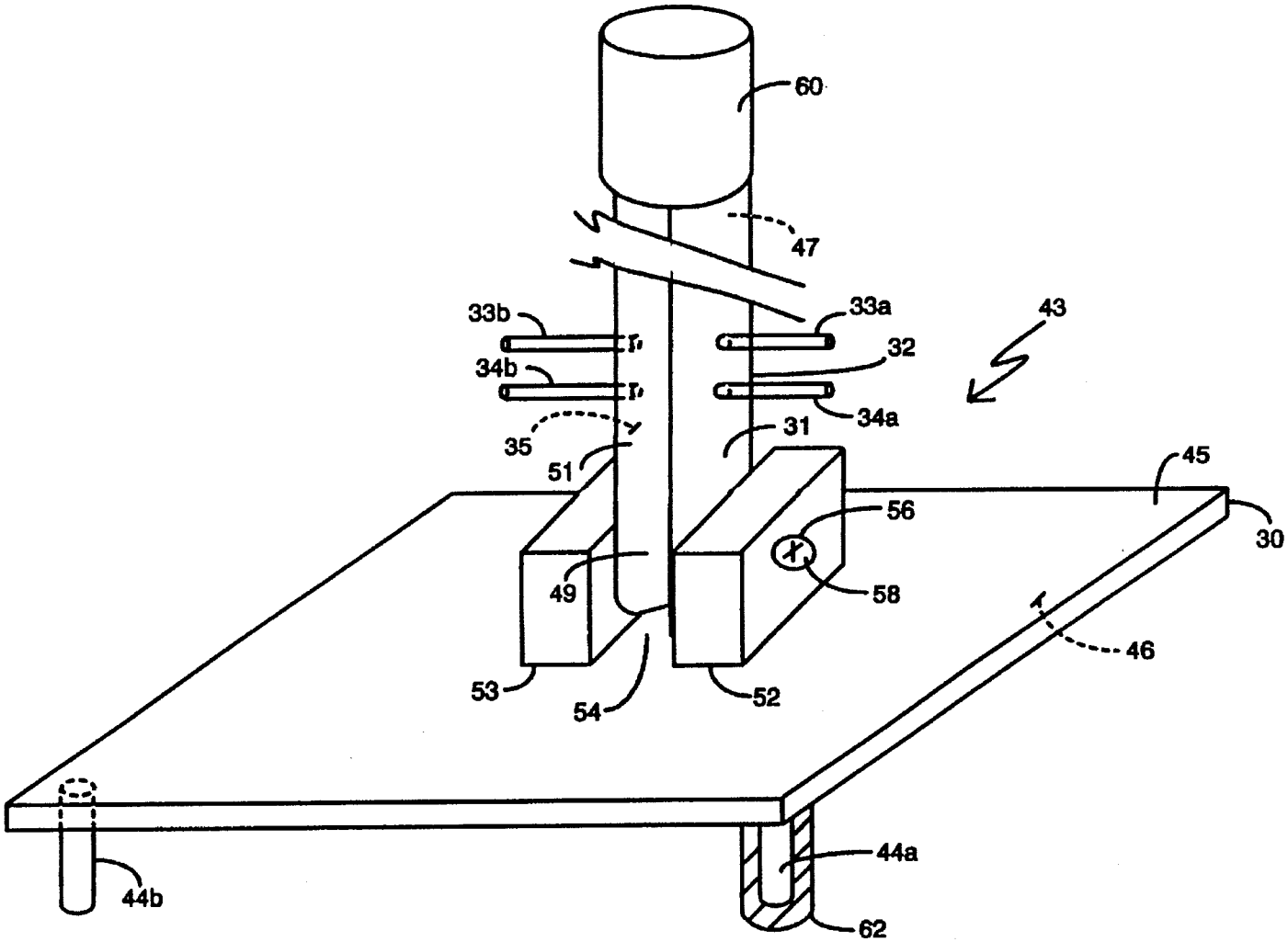
FIG. 3 is an isometric view, from the rear, depicting a lever portion and a base portion of the present invention.

FIG. 3 is a isometric view, from the rear, of the swivel assembly 43 which includes a pair of brackets 52 and 53. The brackets 52 and 53 are attached, in any manner known in the art, to the surface 45 of the base 30. The brackets 52 and 53 are disposed in a spaced-apart relationship such that a space region 54 is formed therebetween. The region 54 is sufficiently wide so as to freely accommodate the end 49 of the lever 32. A hole 56 is formed through the bracket 52. Similarly, a hole (not shown) is formed through the bracket 53. The lever 32 is disposed between the brackets 52 and 53 such that the holes in the brackets 52 and 53 are in registration with the hole 50 formed in the end 49. A pin 58 is passed through the holes formed through the brackets and through the end 49 of the lever 32 so as to enable the lever 32 to pivot or rotate with respect to the brackets 52 and 53. It will be appreciated that the location of the holes formed in the brackets 52 and 53 and the location of the hole formed in the end 49 are such that the lever 32 can pivot 180 degrees in an unobstructed manner along the direction of the arrows C and D (FIG. 2). In an alternate embodiment of the present invention, a bearing sleeve (not shown) is disposed within the holes formed in the brackets in order to facilitate the rotation of the lever.

The latch pins **33*a* and 34*a* are attached to the surface 31. Similarly, the pins 33*b* and 34*b* are attached to the opposing surface 35. The pins may be attached to the corresponding surfaces in any manner known in the art. Pins are attached to both sides of the lever 32 so as to accommodate either fight or left hand operation. Also, a plurality of pins are attached to a side surface of the lever in order to provide a plurality of discrete levels of mechanical leverage that can be applied to remove the pad from the platen. It will be noted, that in alternate embodiments, any number of pins may be attached to only one side surface of the lever, or to both side surfaces of the lever. For example, there may be a single pin or a plurality of pins disposed only on the surface 31 or only on the surface 35. Alternatively, there may be a single pin or more than two pins disposed on each of the surfaces 31 and 35**.

FIG. 3 also depicts an alternate embodiment of the lever 32. More specifically, a handle cover 60 is disposed over the end 48 of the lever 32 to provide a more comfortable gripping surface for the hand of the technician. The cover 60 may be made from rubber, plastic or other resilient material.

Figure 4:
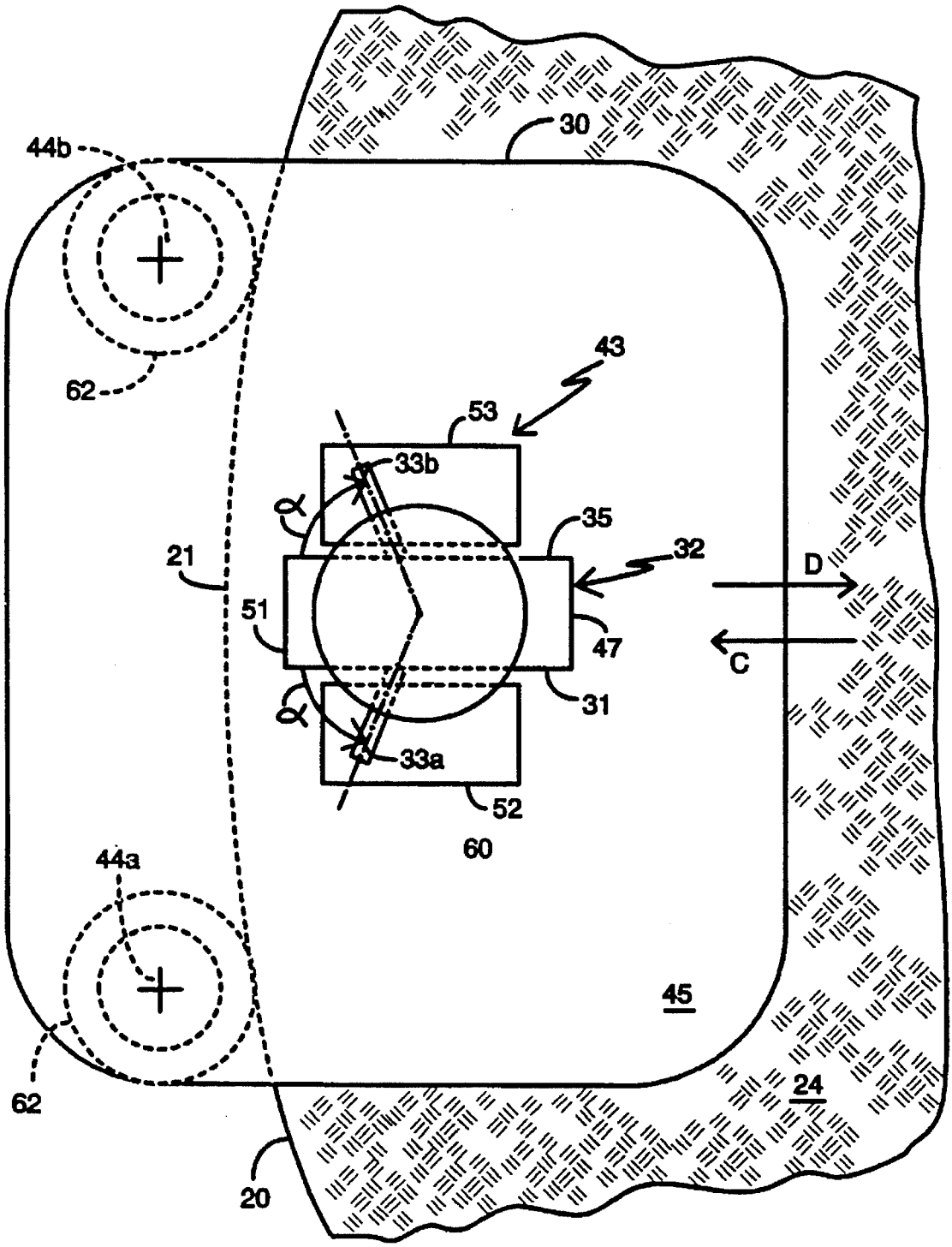
FIG. 4 is a plan view showing the lever portion and the base portion of the present invention depicted in FIG. 3.

The figure also illustrates two embodiments of the downwardly descending stop pins 44 which are attached to the surface 46 of the base 30. In the preferred embodiment, a pin 44*b* is not covered. In an alternate embodiment, a pin 44*a* is disposed within a cover 62 which is shown partially broken away. The material of cover 62 is a resilient material such as rubber or plastic. The cover 62 provides a resilient surface to enhance engaging contact with the platen. FIG. 4 is a plan view of the lever 32 and the base 30 depicted in FIG. 3. The latch pins 33*a* and 33*b* which are mounted, respectively, to the surfaces 31 and 35 of the lever 32 are canted or angled in a generally rearward direction. The term rearward is defined to mean a direction away from the center of platen, i.e., in a direction indicated by the arrow C. In contrast, the term forward is defined to mean a direction towards the center of the platen, i.e., in a direction indicated by the arrow D. The cant angle $\alpha$, which is measured from a mounting surface to the centerline of a corresponding latch pin, ranges from 15 to 25 degrees. FIG. 4 also illustrates the relationship between the stop pins 44*a*, 44*b* and the platen 20. The figure depicts the pins 44*a*, 44*b* as being disposed within a cover 62. When the device 28 is operated, the covers of each of the pins 44*a*, 44*b* are in contact with the near edge 21 of the platen 20. The pins 44*a*, 44*b* act as fingers to brace the base 30 against the platen 20. As the lever is pulled rearward, the pins prevent the base from moving in the forward direction on the pad. Two pins are required to accommodate a platen of any diameter. A base having three or more pins would be stable if used with platens of certain diameters, and would be unstable if used with other sized platens.

In operation, the technician initially grasps and pries away from the platen a portion of the pad disposed proximate the far end of the platen. The clamp means is attached to the portion of the pad that has been pulled up and away from the platen. The base is disposed onto the contact surface of the pad such that the stop pins are in brought into contact with the near edge of the platen. The lever is swung in a forward direction and a canted latch pin is engaged with a link of the chain. The lever is then pulled in a rearward direction thereby pulling the pad from the top surface of the platen. As the lever is pulled in the rearward direction, the pulling force exerted on the lever (and thereby on the pad) by the technician is transferred to the platen by the stop pins. In this manner, the base is braced against the platen, thereby stabilizing the base on the pad and preventing the base from sliding in the forward direction as the lever is pulled in the rearward direction. The lever is rotated up to the maximum extent of its travel (i.e., an angle of 180 degrees) then the canted latch pin is disengaged from the link and the lever is swung forward and into engagement with another link of the chain. The operation is repeated until approximately half of the pad is pulled from the platen. The platen is rotated and the operation is repeated to remove the other half of the pad which is still attached to the platen.

Although the present invention has been described above in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A device for removing a polishing pad adhesively attached to a rotatable platen, comprising:

a) a substantially flat base having a generally planar top surface and a generally planar bottom surface, a first portion of said bottom surface in contact with a top surface of said pad;

b) a lever member pivotally attached to said top surface of said base;

c) at least one latch pin attached to said lever;

d) means for clamping a portion of said pad;

e) a chain having a plurality of links, said clamping means mounted to one end of said chain, said latch pin being engageable with at least one said link; and f) means for bracing said base against said platen, said means for bracing being attached to a second portion of said bottom surface of said base, and whereby when operating said device by contacting said first portion of said base with said top surface of said pad and rotating said lever in a first direction, said bracing means is urged against said platen and said base is prevented from moving in a second direction, said first direction being generally opposite to said second direction, thereby causing said link pin to impart a force on said chain to pry said pad from said platen.

2. A device as recited in claim 1, wherein said means for bracing includes two stop pins attached to and extending from said second portion of said bottom surface of said base, each of said pins being engageable with an edge of said platen.

3. A device as recited in claim 2, wherein said latch pin is canted in a rearward direction.

4. A device as recited in claim 2, wherein each of said stop pins are covered in a resilient material.

5. A device as recited in claim 1, wherein said lever includes a first proximal end and a second distal end, said distal end being pivotally attached to said top surface of said base and said proximal end being covered with a resilient material.

6. A device as recited in claim 2, wherein said lever includes a first proximal end and a second distal end, said distal end being pivotally attached to said top surface of said base and said proximal end being covered with a resilient material.

7. A device for removing a polishing pad adhesively attached to a polishing surface, comprising:

a) a substantially flat base having a generally planar top surface and a generally planar bottom surface, a first portion of said bottom surface in contact with a top surface of said pad;

b) a lever member pivotally attached to said top surface of said base;

c) at least one latch pin attached to said lever;

d) means for clamping a portion of said pad;

e) a chain having a plurality of links, said clamping means mounted to one end of said chain, said latch pin being engageable with at least one said link; and f) means for bracing said base against said polishing surface, said means for bracing being attached to a second portion of said bottom surface of said base, and whereby when operating said device by contacting said first portion of said base with said top surface of said pad and rotating said lever in a first direction, said bracing means is urged against said polishing surface and said base is prevented from moving in a second direction, said first direction being generally opposite to said second direction, thereby causing said link to impart a force on said chain to pry said pad from said polishing surface.

8. A device as recited in claim 7 wherein said means for bracing includes two stop pins attached to and extending from said second portion of said bottom surface of said base, each of said stop pins being engageable with an edge of said polishing surface.

9. A device as recited in claim 8, wherein said latch pin is canted in a rearward direction.

10. A device as recited in claim 8, wherein each of said stop pins are covered in a resilient material.

11. A device as recited in claim 7, wherein said lever includes a first proximal end and a second distal end, said distal end being pivotally attached to said top surface of said base and said proximal end being covered with a resilient material.

12. A device as recited in claim 8, wherein said lever includes a first proximal end and a second distal end, said distal end being pivotally attached to said top surface of said base and said proximal end being covered with a resilient material.

* * * * *